US008731433B2

(12) United States Patent
Kondo

(10) Patent No.: US 8,731,433 B2
(45) Date of Patent: May 20, 2014

(54) IMAGE FORMING APPARATUS IN WHICH AN UPPER FRAME AND COVER MEMBER ARE COMBINED

(75) Inventor: Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 509 days.

(21) Appl. No.: 12/886,084

(22) Filed: Sep. 20, 2010

(65) Prior Publication Data

US 2011/0129250 A1 Jun. 2, 2011

(30) Foreign Application Priority Data

Nov. 27, 2009 (JP) ..... 2009-270368

(51) Int. Cl.
*G03G 15/00* (2006.01)

(52) U.S. Cl.
USPC ..... 399/107

(58) Field of Classification Search
USPC ..... 399/107; 361/679; 271/264
See application file for complete search history.

(56) References Cited

U.S. PATENT DOCUMENTS

| | | | | |
|---|---|---|---|---|
| 6,167,221 | A | 12/2000 | Kobayashi | |
| 6,907,206 | B2 * | 6/2005 | Hattori et al. | 399/107 |
| 7,505,707 | B2 | 3/2009 | Makino | |
| 7,529,499 | B2 | 5/2009 | Makino | |
| 8,056,894 | B2 | 11/2011 | Ichikawa | |
| 8,175,491 | B2 | 5/2012 | Tomatsu et al. | |
| 2004/0247338 | A1 | 12/2004 | Makino | |
| 2007/0041765 | A1 | 2/2007 | Makino | |
| 2007/0077087 | A1 | 4/2007 | Okabe et al. | |
| 2008/0002341 | A1 | 1/2008 | Tomatsu | |
| 2010/0014887 | A1 | 1/2010 | Tomatsu et al. | |
| 2010/0019443 | A1 | 1/2010 | Ichikawa | |
| 2011/0052251 | A1 * | 3/2011 | Kondo | 399/107 |

FOREIGN PATENT DOCUMENTS

| | | | | |
|---|---|---|---|---|
| JP | 60008857 | A * | 1/1985 | |
| JP | 62001567 | A * | 1/1987 | B41J 29/00 |
| JP | H01-169466 | A | 7/1989 | |
| JP | H07-306560 | A | 11/1995 | |
| JP | H08-095169 | A | 4/1996 | |
| JP | H10-194525 | A | 7/1998 | |
| JP | H11-186740 | A | 7/1999 | |

(Continued)

OTHER PUBLICATIONS

Translation of JP2001-166550A to Sueaki et al., Jun. 2001.*

(Continued)

*Primary Examiner* — Quana M Grainger
(74) *Attorney, Agent, or Firm* — Banner & Witcoff, Ltd.

(57) ABSTRACT

An image forming apparatus includes: a main body frame placed on a placement surface; an image forming unit provided at an upper portion in the main body frame and forms an image on a recording medium; and an accommodation unit provided at a lower portion in the main body frame and accommodates the recording medium to be fed to the image forming unit, wherein the main body frame includes an upper frame that supports the image forming unit, and a lower frame that has a rigidity lower than the rigidity of the upper frame, supports the upper frame from below, and supports the accommodation unit, the upper and lower frames are covered with a cover member, and a combining unit is provided between the upper frame and the cover member, and combines the cover member with the upper frame without being restricted by the lower frame.

18 Claims, 9 Drawing Sheets

(56) References Cited

FOREIGN PATENT DOCUMENTS

| | | | | |
|---|---|---|---|---|
| JP | 2000-071558 | A | | 3/2000 |
| JP | 2001-166550 | | | 6/2001 |
| JP | 2002-023440 | A | | 1/2002 |
| JP | 2002-287452 | A | | 10/2002 |
| JP | 2002-297003 | A | | 10/2002 |
| JP | 2002-332127 | A | | 11/2002 |
| JP | 2003-307894 | | | 10/2003 |
| JP | 2004-299817 | A | | 10/2004 |
| JP | 2005-077498 | A | | 3/2005 |
| JP | 2006-235289 | A | | 9/2006 |
| JP | 2006-243749 | | | 9/2006 |
| JP | 2007-006513 | A | | 1/2007 |
| JP | 2007-101635 | | | 4/2007 |
| JP | 2007199159 | A | * | 8/2007 |
| JP | 2008-009262 | | | 1/2008 |
| JP | 2008-282627 | | | 11/2008 |
| JP | 2009-169126 | A | | 7/2009 |
| JP | 2010-044363 | A | | 2/2010 |
| JP | 2010-052423 | A | | 3/2010 |

OTHER PUBLICATIONS

JP Office Action dtd Jun. 11, 2013, JP Appln. 2009-270368, English Translation.

* cited by examiner

IMAGE FORMING APPARATUS IN WHICH AN UPPER FRAME AND COVER MEMBER ARE COMBINED

CROSS REFERENCE TO RELATED APPLICATION

The present application claims priority from Japanese Patent Application No. 2009-270368, which was filed on Nov. 27, 2009, the disclosure of which is herein incorporated by reference in its entirety.

TECHNICAL FIELD

Apparatuses and devices consistent with the present invention relate to an image forming apparatus.

BACKGROUND

A related art image forming apparatus is disclosed. The related art image forming apparatus includes a main body frame that is placed on a placement surface, an image forming unit that is provided at an upper portion in the main body frame and forms an image on a recording medium, and an accommodation unit that is provided at a lower portion in the main body frame and accommodates the recording medium to be fed to the image forming unit.

The main body frame includes an upper frame that supports the image forming unit, and a lower frame that supports the accommodation unit. The upper frame is provided on the lower frame. Each of the upper and lower frames is a housing where a pipe frame, side plates, reinforcing plates, stays, and the like are combined.

Further, the rigidity of the lower frame, which supports the accommodation unit, is lower than that of the upper frame that supports the image forming unit. Accordingly, manufacturing costs are reduced. Furthermore, even when the lower frame is deformed by being placed on a placement surface having irregularities, high positional accuracy of the image forming unit is maintained by suppressing the deformation of the upper frame supporting the image forming unit and the deterioration of image quality at the time of image formation is prevented.

SUMMARY

Meanwhile, the related art image forming apparatus disclosed above has been generally provided with a cover member that covers the upper and lower frames, in order to improve appearance quality. In this case, for example, if the cover member is combined with the upper and lower frames, the deformation of the lower frame, which has a rigidity lower than the rigidity of the upper frame, is apt to affect the cover member. That is, a relative positional relationship among the upper frame, the lower frame, and the cover member is changed due to the deformation of the lower frame, so that the cover member combined with the upper and lower frames is deformed. As a result, there is a concern that the appearance quality of the image forming apparatus will deteriorate.

The invention has been made in consideration of the circumstances in the related art image forming apparatus, and an object of the invention is to provide an image forming apparatus that can prevent the deterioration of appearance quality.

According to an illustrative aspect of the present invention, there is provided an image forming apparatus comprising: a main body frame that is placed on a placement surface; an image forming unit that is provided at an upper portion in the main body frame and forms an image on a recording medium; and an accommodation unit that is provided at a lower portion in the main body frame and accommodates the recording medium to be fed to the image forming unit, wherein the main body frame includes an upper frame that supports the image forming unit, and a lower frame that has a rigidity lower than the rigidity of the upper frame, supports the upper frame from below, and supports the accommodation unit, the upper and lower frames are covered with a cover member, and a combining unit is provided between the upper frame and the cover member, and combines the cover member with the upper frame without being restricted by the lower frame.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

A laser printer 100 according to an embodiment of the invention will be described below with reference to drawings.

<Entire Structure of Laser Printer>

Figure 1:
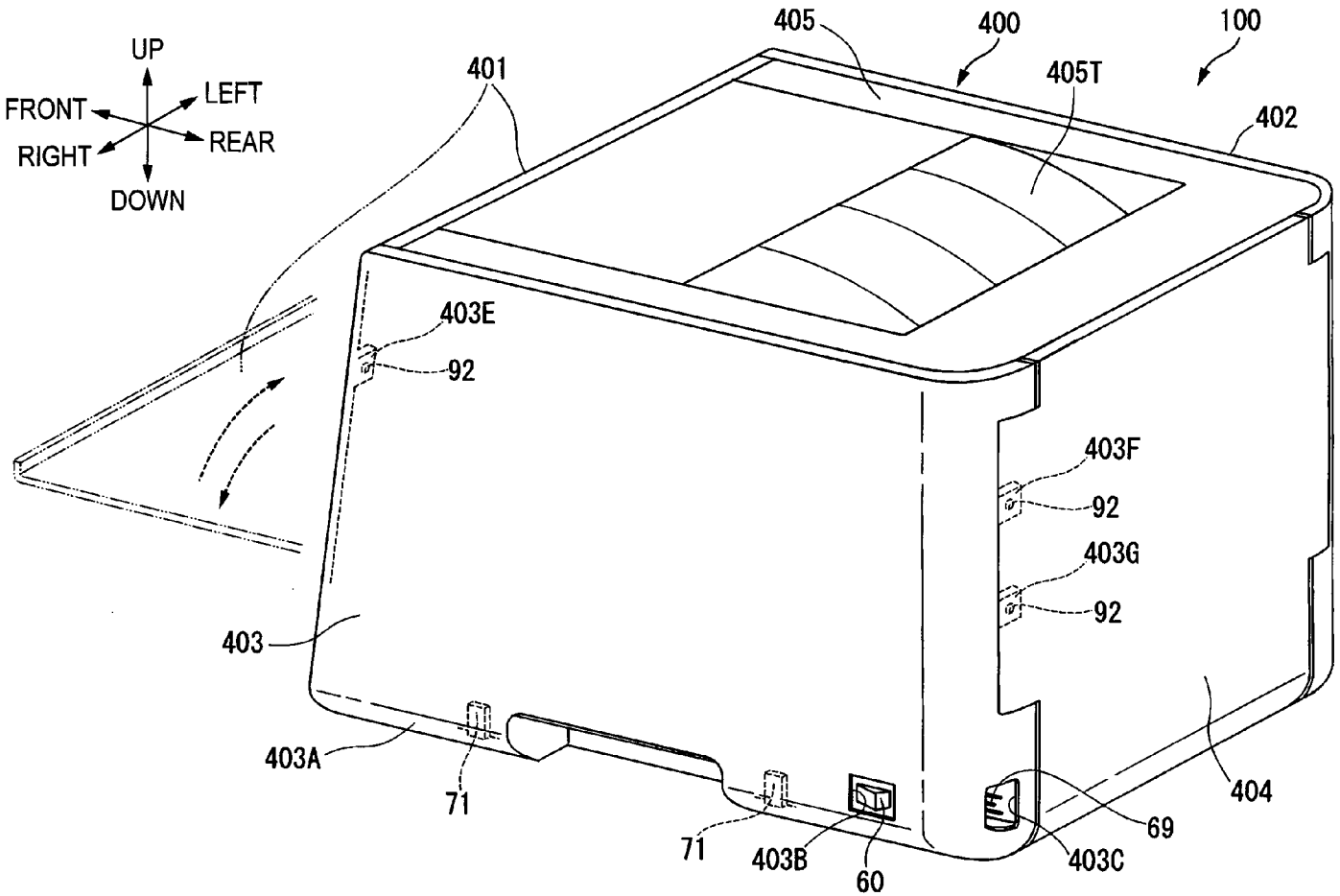
FIG. 1 is a perspective view of an image forming apparatus according to an embodiment.

As shown in FIG. 1, a laser printer 100 is a color laser printer that forms an image having a plurality of colors on a sheet (which includes an OHP sheet and the like) as a recording medium by using an electrophotographic system. A left side in the plane of FIG. 1 is defined as the front side of an apparatus, and a right side in the plane of FIG. 1 is defined as the rear side of an apparatus. Further, a left side (a back side of the plane of FIG. 1), when the apparatus is seen from the front side, is defined as the left side, and a side opposite thereto (a front side of the plane of FIG. 1) is defined as the right side. Then, the directions corresponding to front, rear, left, right, upper, and lower sides are shown. Furthermore, the respective directions shown in FIGS. 2 to 6 and 8 to 10 are shown so as to correspond to the respective directions shown in FIG. 1.

As shown in FIG. 1, the outside of the laser printer 100 is covered with a cover member 400 that is made of a resin and is designed so as to have good appearance quality. The cover member 400 includes a front cover 401, a left side cover 402, a right side cover 403, a rear cover 404, and an upper cover 405.

The front cover 401 usually closes the front side of the laser printer 100. However, the front cover swings forward about a pivot shaft (not shown), which is provided at a lower portion of the front cover, so as to open the front side of the laser printer 100 (the opened front cover 401 is shown in FIG. 1 by a two-dot chain line).

Figure 2:
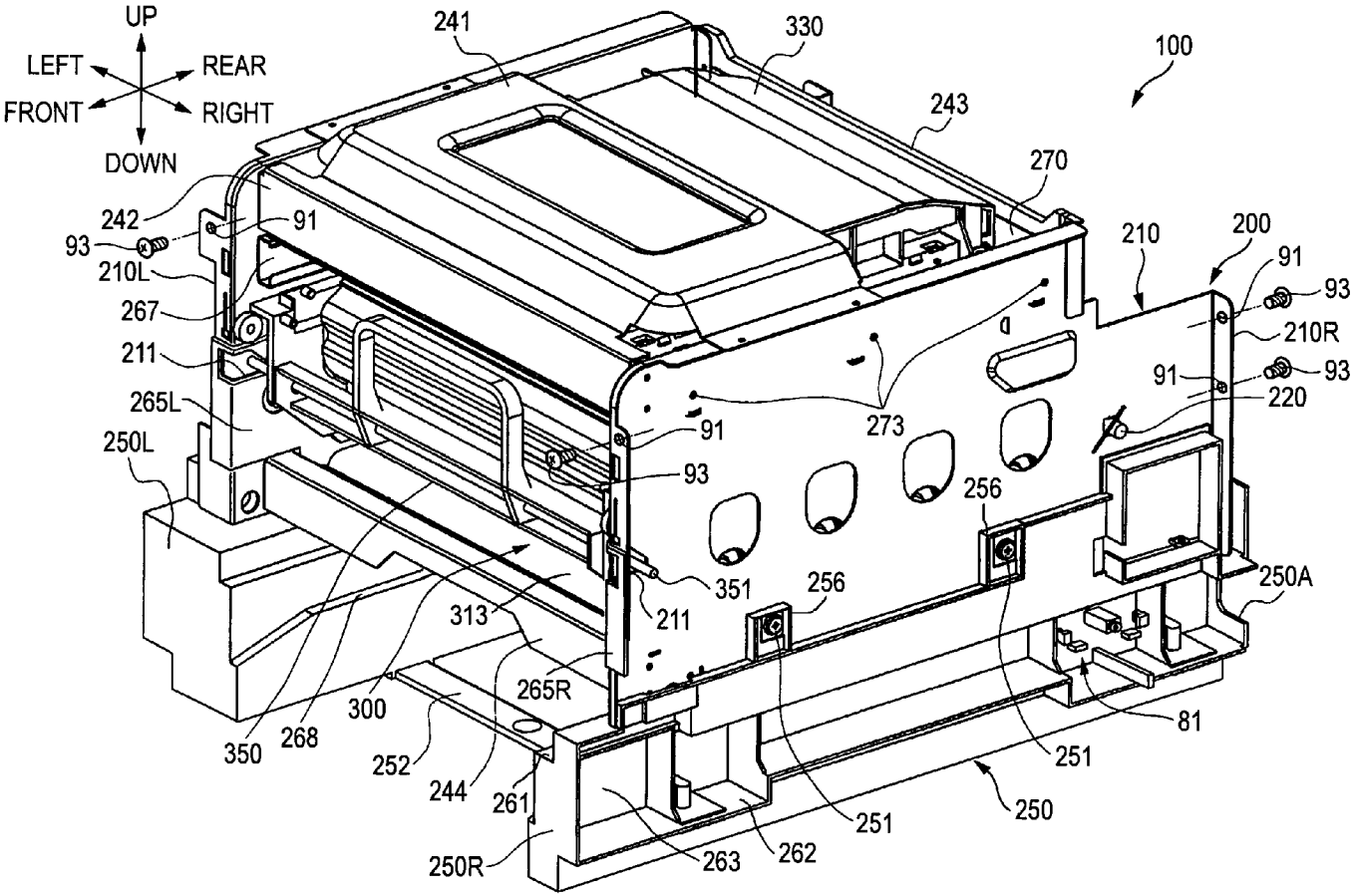
FIG. 2 is a perspective view showing the internal structure of the image forming apparatus according to the embodiment.
Figure 3:
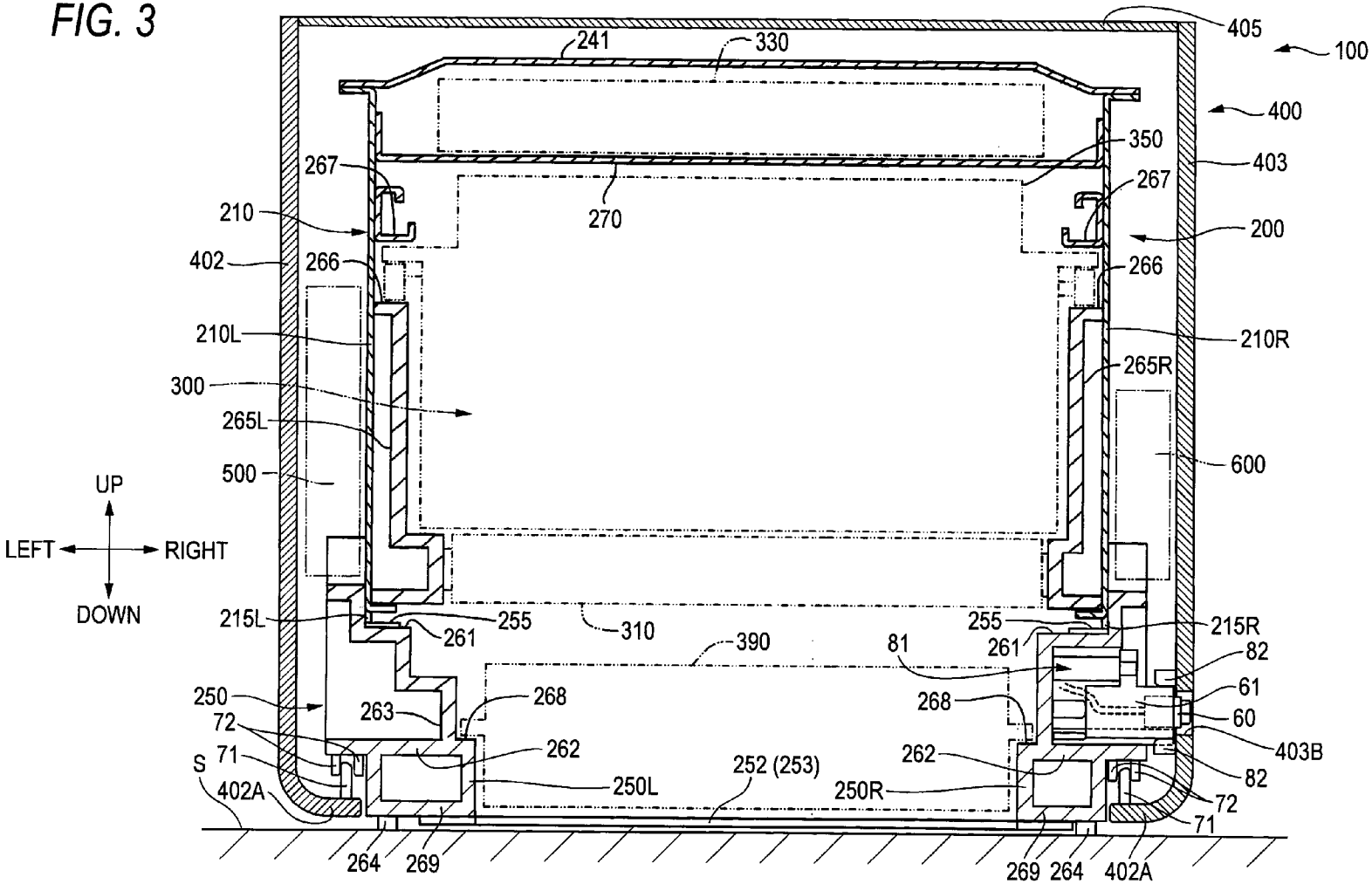
FIG. 3 is a schematic cross-sectional view of the image forming apparatus according to the embodiment.

As shown in FIGS. 2 and 3, the laser printer 100 includes a main body frame 200 in the cover member 400. Image forming unit 300 is provided at an upper portion in the main body frame 200. Meanwhile, as shown in FIG. 3, a feed tray 390 (an example of "accommodation unit" of the invention) and the like is provided at a lower portion in the main body frame 200 (FIG. 2 shows that the feed tray 390 is separated). The main body frame 200 will be described in detail below.

<Structure of Image Forming Unit>

Figure 4:
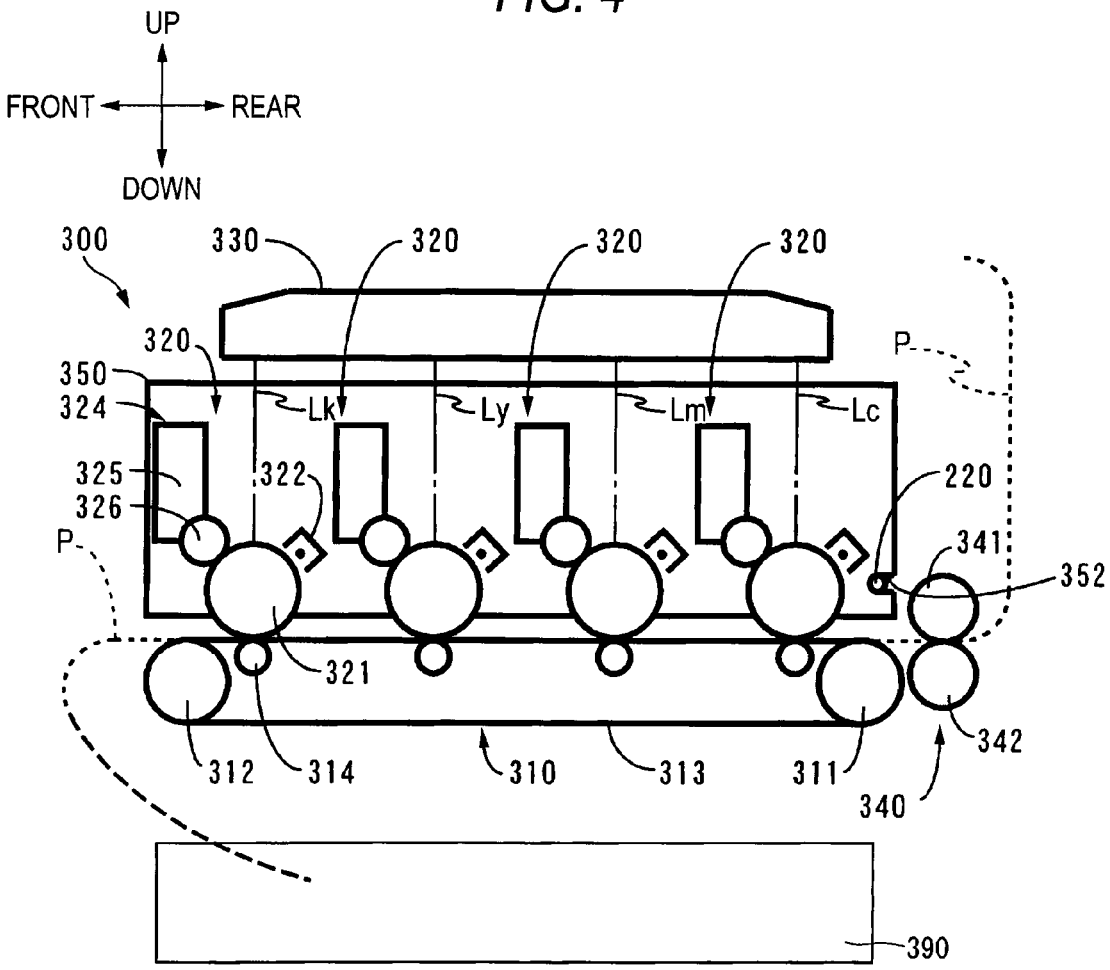
FIG. 4 is a schematic view showing the schematic structure of image forming unit and accommodation unit of the image forming apparatus according to the embodiment.

As shown in FIG. 4, the image forming unit 300 includes four image forming units 320 that correspond to black (K), yellow (Y), magenta (M), and cyan (C), respectively; and a belt unit 310 that includes a conveying belt 313 stretched between a driving roller 311 and a driven roller 312. The image forming units 320 are positioned above the belt unit 310. The four image forming units 320 are arranged in a line in a front-rear direction from the front side of the printer 100 in order of black, yellow, magenta, and cyan (the above-mentioned structure is referred to as a "direct tandem type structure". Further, the four image forming units 320 are detachably held in four receiving portions (not shown) that are formed at a drawer unit 350, respectively. Meanwhile, as described below, the drawer unit 350 is formed to be separated from the main body frame 200 by being pulled out toward the front side of the apparatus when the front cover 401 is opened.

Each of the image forming units 320 includes a photoconductor unit 321 that is formed in the shape of a cylindrical drum, a scorotron charger 322, and a developing cartridge 324. The photoconductor unit 321 includes a drum main body that is grounded and made of metal, and a surface layer of the drum main body is covered with a photosensitive layer that has a positive charging property and is made of polycarbonate or the like.

The scorotron charger 322 is disposed on the upper rear side of the photoconductor unit 321 in an oblique direction with a predetermined distance between the photoconductor unit and itself so as to face the photoconductor unit 321 without coming into contact with the photoconductor unit. The scorotron charger 322 uniformly and positively charges the surface of the photoconductor unit 321 with electricity by generating corona discharge from a charge wire that is made of tungsten or the like. The developing cartridge 324 is a well-known developing cartridge that includes a toner storage chamber 325 therein. After positively charging a black, cyan, magenta, or yellow nonmagnetic one-component toner, which has a positive charging property and is stored in the toner storage chamber, with electricity by friction, the developing cartridge supplies the toner to the photoconductor unit 321 by a developing roller 326.

The belt unit 310 includes the conveying belt 313 that is stretched between the driving roller 311 and the driven roller 312. The conveying belt 313 extends in an arrangement direction of the respective photoconductor units 321 of the plurality of image forming units 320, and is rotationally driven in the arrangement direction by the rotation of the driving roller 311. In addition, the belt unit 310 includes a plurality of transfer rollers 314 disposed at positions facing the respective photoconductor units 321 so that the conveying belt 313 is interposed between the transfer rollers 314 and the photoconductor units 321. A sheet P is fed onto the conveying belt 313 from the feed tray 390 by various rollers (not shown) such as sheet feed rollers, and the sheet P is conveyed to the rear portion of the laser printer 100 through portions that face the respective photoconductor units 321.

A scanner unit 330 is provided above the respective image forming units 320. The scanner unit 330 is a well-known scanner unit that includes semiconductor lasers (not shown) for generating laser beams Lk, Ly, Lm, and Lc corresponding to the respective color image data and a polygon mirror (not shown) for deflecting the laser beams L, and scans and exposes the respective photoconductor units 321. Accordingly, the surfaces of the respective photoconductor units 321 are uniformly and positively charged first with electricity by the scorotron chargers 322 during the rotation of the respective photoconductor units. After that, the respective photoconductor units are exposed by the rapid scanning using the laser beams Lk to Lc generated by the scanner unit 330. As a result, electrostatic latent images corresponding to images to be formed on the sheet P are formed. Then, when facing and coming into contact with the photoconductor units 321, the positively charged toner carried on the developing rollers 326 is supplied to the electrostatic latent images, which are formed on the surfaces of the photoconductor units 321, by the rotation of the developing rollers 326. Accordingly, the electrostatic latent images formed on the photoconductor units 321 are changed into visible images, so that toner images where toner is attached only to exposed portions are carried on the surfaces of the photoconductor units 321.

After that, when the sheet P to be conveyed by the conveying belt 313 passes through gaps between the photoconductor units 321 and the transfer rollers 314, the toner images carried on the surfaces of the respective photoconductor units 321 are sequentially transferred to the sheet P by a negative transfer bias that is applied to the transfer rollers 314 through constant current control. The sheet P to which the toner images have been transferred is then conveyed to a fixer 340 that is provided on the rear side of the belt unit 310.

The fixer 340 includes a heating roller 341 that includes a heat source such as a halogen lamp and is rotationally driven, and a pressing roller 342 that is disposed below the heating roller 341 so as to face the heating roller and is rotated. In the fixer 340, the sheet P carrying four color toner images is heated while being interposed between the heating roller 341 and the pressing roller 342 and conveyed. Accordingly, the toner images are thermally fixed to the sheet P. Further, the sheet P to which the toner images have been thermally fixed is discharged to a discharge tray 405T (see FIG. 1), which is recessed on the upper cover 405 of the laser printer 100, by various rollers (not shown).

<Entire Structure of Main Body Frame>

Figure 5:
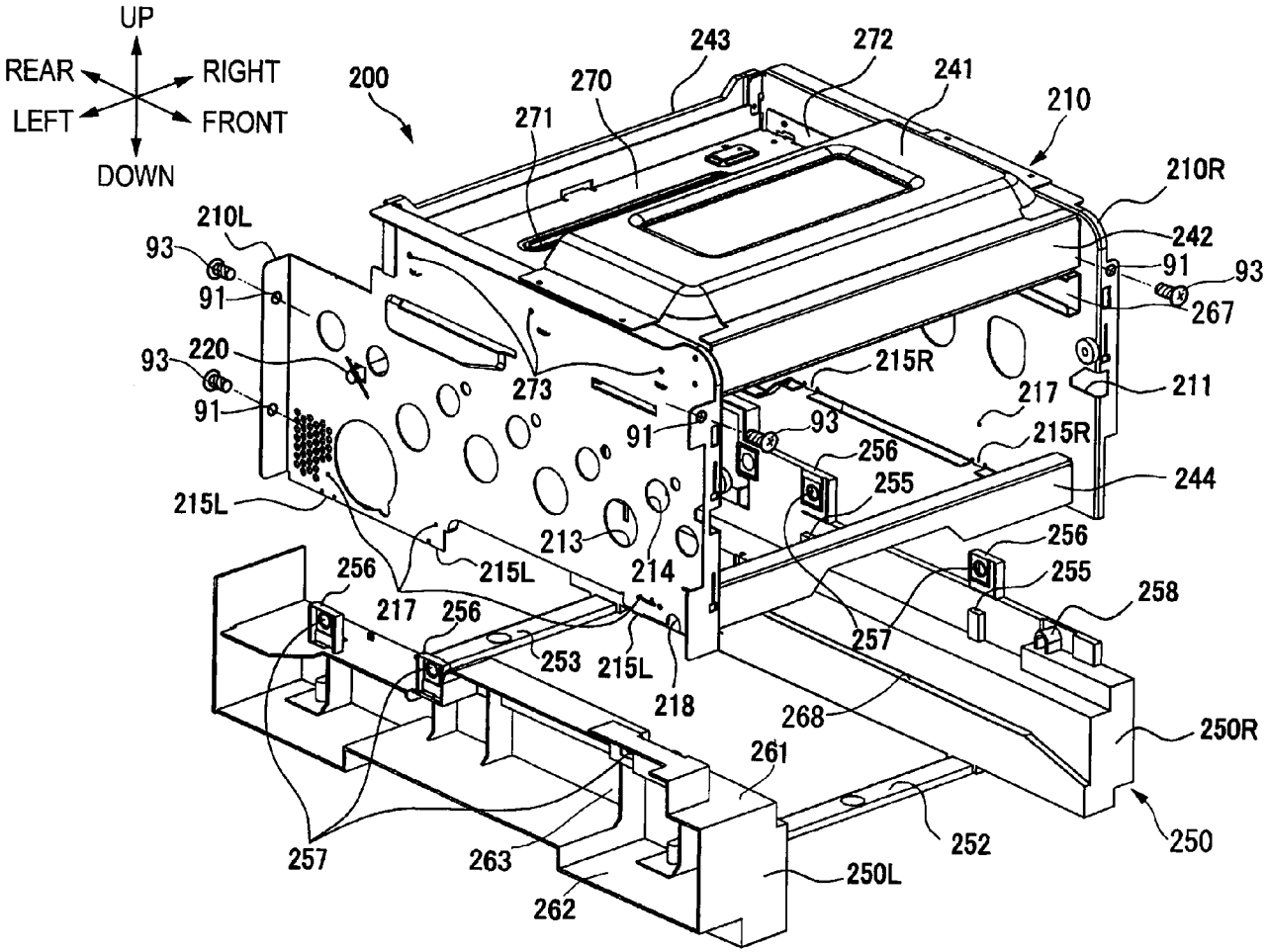
FIG. 5 is a perspective view of a main body frame of the image forming apparatus according to the embodiment.

As shown in FIGS. 3 and 5, the main body frame 200 is a frame-like body that includes upper and lower frames 210 and 250 and is opened in a front-rear direction. The upper frame 210 includes an upper first side plate 210L and an upper second side plate 210R that form a pair of (left and right) side walls; and upper connecting members 270, 241, 242, 243, and 244 that connect the upper first side plate 210L to the upper second side plate 210R. The lower frame 250 includes a lower first side plate 250L and a lower second side plate 250R that form a pair of (left and right) side walls; and lower connecting members 252 and 253 that connect the lower first side plate 250L to the lower second side plate 250R.

The upper first side plate 210L and the upper second side plate 210R are formed of a metal sheet such as a steel plate, and face each other with a distance therebetween in a left-right direction. Specifically, the image forming unit 300 is interposed between the upper first side plate 210L and the upper second side plate 210R, the upper first side plate and the upper second side plate stand on both the left and right sides of the image forming unit so as to be substantially parallel to each other, and the upper first side plate and the upper second side plate are formed in the shape of a flat plate extending in the front-rear direction orthogonal to an up-down direction (a direction parallel to a direction where a sheet P is conveyed on the belt 313). In addition, each of the upper first side plate 210L and the upper second side plate 21 OR includes bent edges, which are bent in a direction orthogonal to the flat plate portion thereof, at the outer peripheral portion thereof in order to increase rigidity.

The lower first side plate 250L and the lower second side plate 250R are made of a resin, extend in the front-rear direction below the upper first side plate 210L and the upper second side plate 210R so as to be parallel to the upper first side plate and the upper second side plate, and have substantially the same length as the length of the upper first side plate and the upper second side plate in the front-rear direction. Specifically, each of the lower first side plate 250L and the lower second side plate 250R includes an upper wall 261, an intermediate wall 262, a lower wall 269, and a side wall 263 that are integrally formed. The upper wall 261 extends in a substantially horizontal direction. Likewise, the intermediate wall 262 extends in a substantially horizontal direction below the upper wall 261 with a distance therebetween. Likewise, the lower wall 269 extends in a substantially horizontal direction below the intermediate wall 262 with a distance therebetween. The side wall 263 connects the upper wall 261, the intermediate wall 262, and the lower wall 269 in the up-down direction. The outer end of the intermediate wall 262 protrudes more than the outer end of the lower wall 269 in the left-right direction. Accordingly, spaces, which are opened to the outside in the left-right direction, are secured outside the lower walls 269 of the lower first side plate 250L and the lower second side plate 250R in the left-right direction and below the intermediate walls 262 thereof. As shown in FIG. 3, lower edges 402A and 403A of the left and right side covers 402 and 403 are bent into these spaces as described below.

The shape of each of the lower first side plate 250L and the lower second side plate 250R is set by appropriately adjusting a section modulus so that the upper frame 210, the image forming unit 300, and the like are stably supported. Meanwhile, in this embodiment, ribs, which are formed integrally with the lower first side plate 250L and the lower second side plate 250R, are partially omitted in the drawings to facilitate understanding of the respective drawings. It may be possible to easily adjust the rigidity of the lower first side plate 250L and the lower second side plate 250R by appropriately adjusting the disposition or the number of the ribs that are formed integrally with the lower first side plate 250L and the lower second side plate 250R formed of resin members. As a result, manufacturing costs are reliably reduced.

As shown in FIG. 3, the corresponding upper first side plate 210L and upper second side plate 210R are supported while the upper first side plate and the upper second side plate are placed on the upper surfaces of the upper walls 261 of the lower first side plate 250L and the lower second side plate 250R. The lower surfaces of the lower walls 269 thereof face a placement surface S. Legs 264, which come into contact with the placement surface S, protrude downward from the lower surfaces of the lower walls 269 near both ends of the lower walls in the front-rear direction. Meanwhile, the supporting structures of the lower first side plate 250L and the lower second side plate 250R, which support the upper first side plate 210L and the upper second side plate 210R, will be described in detail below.

As shown in FIGS. 3 and 5, the connecting member 270, which connects the upper first side plate 210L to the upper second side plate 210R, is a scanner plate that supports the scanner unit 330 and is formed of a metal sheet. Both left and right edges 272 of the connecting member 270 are bent upward at right angles, and are fixed to the upper end portions of the inner surfaces of the upper first side plate 210L and the upper second side plate 210R, respectively, at plural positions in the front-rear direction by locking screws 273 (see FIG. 5). Accordingly, the connecting member 270 firmly connects the upper first side plate 210L to the upper second side plate 210R. Four slits 271 (only one rear slit 271 is shown in FIG. 5.), which are arranged in a line in the front-rear direction, are formed at the connecting member 270. Laser beams Lk to Lc are rapidly irradiated to positions, which correspond to the respective photoconductor units 321, from the scanner unit 330, which is placed on the upper surface of the connecting member 270, through the respective slits 271.

The connecting member 241 is a scanner cover that is formed of a metal sheet and covers the front half of the scanner unit 330 from above. The connecting member 241 is fixed to the bent edges, which are bent outward from the upper ends of the upper first side plate 210L and the upper second side plate 210R, by locking screws.

The connecting member 242 is an upper front beam that connects and fixes a front upper corner of the inner surface of the upper first side plate 210L to a front upper corner of the inner surface of the upper second side plate 210R. The connecting member 243 is a rear beam that connects and fixes a rear upper corner of the inner surface of the upper first side plate 210L to a rear upper corner of the inner surface of the upper second side plate 210R. The connecting member 244 is a lower front beam that connects and fixes a front lower portion of the inner surface of the upper first side plate 210L to a front lower portion of the inner surface of the upper second side plate 210R. Each of the connecting members 242, 243, and 244 is formed of a bent metal sheet or a reinforced resin, and both left and right ends of these connecting members are fixed to the inner surfaces of the upper first side plate 210L and the upper second side plate 210R by locking screws. The frame connecting member 244 is provided below the drawer unit 350 so as not to interrupt the pulling operation of the drawer unit 350.

The connecting member 252 is a front beam that connects and fixes a front portion of the lower wall 269 of the lower first side plate 250L to a front portion of the lower wall 269 of the lower second side plate 250R. The connecting member 252 is a rear beam that connects and fixes a rear portion of the lower wall 269 of the lower first side plate 250L to a rear portion of the lower wall 269 of the lower second side plate 250R. Each of the connecting members 252 and 253 is formed of a bent metal sheet or a reinforced resin, and both left and right ends of these connecting members are fixed to the lower walls 269 of the lower first side plate 250L and the lower second side plate 250R by locking screws. Meanwhile, a resin, which is reinforced by, for example, a glass fiber, a filler, other additives, or the like, is used as the reinforced resin.

The upper frame 210, which includes the upper first side plate 210L, the upper second side plate 210R, and the connecting members 241, 242, 243, 244, and 270 as shown in FIG. 3, forms a frame-like body, which surrounds the drawer unit 350, when seen in the front-rear direction. Further, the lower frame 250, which includes the lower first side plate 250L, the lower second side plate 250R, and the connecting members 252 and 253, forms a frame-like body, which surrounds the feed tray 390, together with the upper frame 210 when seen in the front-rear direction.

Inner support plates 265L and 265R are fixed to the upper first side plate 210L and the upper second side plate 210R along the inner surfaces of the upper first side plate and the upper second side plate, which face each other, respectively. The upper end faces of the inner support plates 265L and 265R are formed as rail members 266 that extend substantially linearly in the front-rear direction. Guide members 267, which form a guide space together with the rail members 266, are fixed to the inner surfaces of the upper first side plate 210L and the upper second side plate 210R above the rail members 266. The drawer unit 350 is supported on the rail members 266 so as to slide in the front-rear direction. Moreover, if the drawer unit 350 is pulled out toward the front side of the upper first side plate 210L and the upper second side plate 210R, the drawer unit 350 is guided by the rail members 266 and the guide members 267, is moved forward, and is separated from the main body frame 200. In contrast, if the drawer unit 350 is pressed rearward toward the upper first side plate 210L and the upper second side plate 210R from the front of the main body frame 200, the drawer unit 350 is guided by the rail members 266 and the guide members 267, is moved rearward, and is mounted in the main body frame 200.

As shown in FIGS. 2 and 5, a pair of holes 211, which reach a part of the bent edges from the flat plate portions, is formed at the front ends of the upper first side plate 210L and the upper second side plate 210R. The holes 211 are opened to the front side, and the lower ends of the holes extend in the horizontal direction. Further, a shaft member 220, which is installed in the left-right direction, is provided between the upper first side plate 210L and the upper second side plate 210R at the rear ends of the upper first side plate 210L and the upper second side plate 210R.

When the drawer unit 350 is mounted in the main body frame 200, a shaft member 351, which protrudes from the front end portion of the drawer unit 350 to the outside in the left-right direction, is placed at the lower ends of the pair of holes 211 as shown in FIG. 5. Accordingly, the front end portion of the drawer unit 350 is positioned in the up-down direction. At the same time, a cutout portion (not shown) formed at the rear end of the drawer unit 350 is engaged with the shaft member 220. Therefore, the rear end of the drawer unit 350 is positioned in the up-down direction and the front-rear direction. As a result, when the drawer unit 350 is mounted in the main body frame 200, the plurality of photoconductor units 321 is provided at a predetermined position in the front-rear direction with high positioning accuracy and with a predetermined distance between the scanner unit 330 and themselves.

As shown in FIG. 5, circular holes 213 and 214, into which drive couplings (not shown) for driving the photoconductor units 321 and the developing rollers 326 are inserted, are formed at the left upper first side plate 210L and the inner support plate 265L fixed to the inner surface of the upper first side plate. Meanwhile, as shown in FIG. 3, a drive unit 500, which drives the respective drive couplings by a motor, is fixed outside the left upper first side plate 210L in the left-right direction. Meanwhile, since the structures of the drive unit 500 and these drive couplings are well known from, for example, JP-A-2007-101635 and JP-A-2008-9262, the detailed description thereof will be omitted.

As shown in FIG. 2, electrical contacts (not shown) connected to the image forming units 320 are disposed on the side surface of the drawer unit 350 facing the right inner support plate 265R, and electrical contacts (not shown) that come into contact with the electrical contacts or a control unit 600 that includes a power circuit and a control circuit are provided on the right inner support plate 265R. It may be possible to supply current to respective portions in the image forming units 320 or to transmit control signals to the respective portions in the image forming units by the control unit 600 and the electrical contacts.

As shown in FIG. 3, the belt unit 310 is bridged and detachably mounted between the lower portions of the pair of inner support plates 265L and 265R. Accordingly, at this mounting position, the belt unit faces the respective photoconductor units 321 in the up-down direction. Although not shown, the fixer 340 is bridged and mounted between the rear portions of the upper first side plate 210L and the upper second side plate 210R.

As shown in FIG. 3, the feed tray 390, which stores sheets P, is received between the lower first side plate 250L and the lower second side plate 250R, and is supported on rail members 268 provided on the side surfaces, which face each other, of the lower first side plate and the lower second side plate so as to slide in the front-rear direction. While the feed tray 390 is pulled out toward the front side from the space between the lower first side plate 250L and the lower second side plate 250R, the feed tray 390 may be replenished with sheets P. Meanwhile, when the feed tray 390 is mounted at a predetermined position below the belt unit 31, a well-known sheet feed roller comes into contact with a sheet P stored in the feed tray 390 and may feed the sheet P to the belt unit 31. Although not shown, various rollers such as a sheet feed roller provided between the feed tray 390 and the belt unit 31 are bridged and mounted between the front portions of the upper first side plate 210L and the upper second side plate 210R. If positioning accuracy, which is required for the fixer 340 or the various rollers such as a sheet feed roller, is not particularly high, the fixer or the various rollers may be mounted on the lower frame 250. Further, various rollers may be unitized, and a unit in which various rollers are received may be mounted on the upper frame.

<Supporting Structure of Lower Frame for Supporting Upper Frame>

As shown in FIGS. 3 and 5, a plurality of protruding pieces 215L and 215R, which protrudes downward in a rectangular shape, is formed at the lower edges of the upper first side plate 210L and the upper second side plate 210R. In this embodiment, two protruding pieces of the protruding pieces 215L and 215R are formed at the right upper second side plate 210R with a distance therebetween in the front-rear direction, and three protruding pieces of the protruding pieces 215L and 215R are formed at the left upper first side plate 210L. The reason why the number of the protruding piece 215L provided on the left side is larger is that the heavy drive unit 500 is mounted on the side of the left upper first side plate 210L.

Portions of the lower edges of the upper first side plate 210L and the upper second side plate 210R except for the protruding pieces 215L and 215R are bent toward the inside in the left-right direction (toward the belt unit 310). Meanwhile, pedestal portions 255 (in FIG. 5, only two pedestal portions 255 formed at the lower first side plate 250R are shown and three pedestal portions 255 formed at the lower second side plate 250L are omitted) are formed at the lower first side plate 250L and the lower second side plate 250R at positions corresponding to the protruding pieces 215L and 215R. The upper first side plate 210L and the upper second side plate 210R are placed such that the lower ends of the protruding pieces 215L and 215R come into contact with the upper surfaces of the respective pedestal portions 255.

The protruding pieces 215L and 215R, which are positioned at both ends of the upper first side plate 210L and the upper second side plate 210R in the front-rear direction, are formed at the upper first side plate 210L and the upper second side plate 210R with a predetermined distance therebetween in the front-rear direction. Accordingly, gaps are secured between the lower ends of the upper first side plate 210L and the upper second side plate 210R and the lower first side plate 250L and the lower second side plate 250R, on the outside of the positions of the protruding pieces 215L and 215R in the front-rear direction.

The weight of the upper first side plate 210L, the upper second side plate 210R, the connecting members 241, 242, 243, 244, and 270, the image forming unit 300 (which includes the drawer unit 350, the scanner unit 330, the fixer 340, and the belt unit 310), the drive unit 500, and the control unit 600, and the like is applied to the lower first side plate 250L and the lower second side plate 250R from the respective protruding pieces 215L and 215R through the upper surfaces of the respective pedestal portions 255. Further, the lower first side plate 250L and the lower second side plate 250R support their weight. Since the lower first side plate 250L and the lower second side plate 250R are placed on the placement surface S with the respective legs 264 interposed therebetween, the respective legs may be elastically deformed appropriately according to the condition of the placement surface S.

As shown in FIG. 5, U-shaped cutout portions 218 (only a left cutout portion 218 is shown), of which arc-shaped portions face the upper side, are formed at the lower edges of the front end portions of the upper first side plate 210L and the upper second side plate 210R, and U-shaped protrusions 258 (only a right protrusion 258 is shown), of which arc-shaped portions of sections face the upper side, are formed at portions of the lower first side plate 250L and the lower second side plate 250R that face the cutout portions 218. The positions of the upper first side plate 210L and the upper second side plate 210R relative to the lower first side plate 250L and the lower second side plate 250R in the front-rear direction are defined by the engagement between the respective cutout portions 218 and the respective protrusions 258.

As shown in FIGS. 2 and 5, a plurality of mounting pieces 256, which protrudes upward, is formed at the lower first side plate 250L and the lower second side plate 250R near the respective pedestal portions 255. An insertion hole 257 for a locking screw 251 is formed at each of the mounting pieces 256. Screw holes 217 (see FIG. 5) are formed in portions of the upper first side plate 210L and the upper second side plate 210R, which face the insertion holes 257, when the respective protruding pieces 215L and 215R come into contact with the respective pedestal portions 255, the cutout portions 218 and the protrusions 258 are engaged with each other, and the respective mounting pieces 256 are parallel to the outer surfaces of the upper first side plate 210L and the upper second side plate 210R. The locking screws 251 are screwed into the screw holes 217 through the insertion holes 257, so that the upper first side plate 210L and the upper second side plate 210R are fixed to the lower first side plate 250L and the lower second side plate 250R.

Although not shown, the locking screw 251 is formed of a so-called shoulder screw and the insertion hole 257 is formed so that the width of the insertion hole in the up-down direction and the length of the insertion hole in the front-rear direction are significantly larger than the diameter of the stepped portion thereof. Accordingly, the locking screw 251 loosely fixes the mounting piece so as to allow the relative movement of the mounting piece in the front-rear direction and the up-down direction without strongly pressing the mounting piece 256 against the upper first side plate 210L and the upper second side plate 210R. Therefore, it may be possible to fix the lower first side plate 250L and the lower second side plate 250R to the upper first side plate 210L and the upper second side plate 210R without affecting the contact between the protruding pieces 215L and 215R and the respective pedestal portions 255, and the engagement positions between the cutout portions 218 and the protrusions 258.

If an impact is applied to the upper first side plate 210L and the upper second side plate 210R from above or any one of the legs 264 is lifted due to irregularities on the placement surface S in the laser printer 100 including the main body frame 200 having the above-mentioned structure, there is a possibility that, for example, the lower first side plate 250L and the lower second side plate 250R formed of resin members are elastically deformed so as to be bent upward in the front-rear direction or elastically deformed so as to be bent downward in the front-rear direction. Further, there is a possibility that, for example, the lower first side plate 250L and the lower second side plate 250R will be elastically deformed so as to be twisted. In this case, since gaps exist between the upper surfaces of the extended portions of the lower first side plate 250L and the lower second side plate 250R and the lower ends of the upper first side plate 210L and the upper second side plate 210R, the elastic deformation of the lower first side plate 250L and the lower second side plate 250R does not particularly affect the upper first side plate 210L and the upper second side plate 210R.

Furthermore, even though bending moments, torsional moments, or the like are applied to the upper first side plate 210L and the upper second side plate 210R from the lower first side plate 250L and the lower second side plate 250R, the moments act on the upper first side plate 210L and the upper second side plate 210R in the up-down direction, that is, along the surface direction of the upper first side plate 210L and the upper second side plate 210R. Here, each of the upper first side plate 210L and the upper second side plate 210R is formed of a metal sheet, and the peripheral edges thereof are subjected to bending. Moreover, the upper first side plate 210L and the upper second side plate 210R form frame-like bodies by the connecting members 241, 242, 243, 244, and 270. For this reason, the upper frame has a rigidity higher than the rigidity of the lower frame 250 that includes the lower first side plate 250L and the lower second side plate 250R formed of resin members. Accordingly, the upper frame 210 may maintain high positional accuracy between the respective units of the image forming unit 300, particularly, between the scanner unit 330 and the drawer unit 350, and may prevent deterioration of image quality (for example, color shift of a color image) when the image forming unit 300 forms an image.

In addition, since the linear expansion coefficients of the lower first side plate 250L and the lower second side plate 250R formed of resin members are different from those of the upper first side plate 210L and the upper second side plate 210R formed of metal members, differences may occur in the expansion or contraction caused by temperature change. However, such differences in the dimensions may be absorbed.

<Combination Structure for Combining Left Side Cover and Right Side Cover with Main Body Frame>

In the laser printer 100 according to the embodiment, if the left side cover 402 and the right side cover 403 are combined with the upper frame 210 (for example, the upper first side plate 210L and the upper second side plate 210R) and the lower frame 250 (for example, the lower first side plate 250L and the lower second side plate 250R), the deformation of the lower frame 250, of which the rigidity is lower than the rigidity of the upper frame 210, is apt to affect the left side cover 402 and the right side cover 403. That is, a relative positional relationship among the upper frame 210, the lower frame 250, the left side cover 402, and the right side cover 403 is changed due to the deformation of the lower frame 250. Accordingly, the left side cover 402 and the right side cover 403 combined with the upper frame 210 and the lower frame 250 are deformed. As a result, there is a concern that the appearance quality of the laser printer 100 will deteriorate.

In this regard, the deformation of the left side cover 402 and the right side cover 403 is suppressed in the laser printer 100 by the combination structure to be described in detail below. Meanwhile, the combination structure for combining the left side cover 402 with the main body frame 200 is symmetrical to the combination structure for combining the right side cover 403 with the main body frame 200. Accordingly, the combination structure for combining the right side cover 403 will be described, and the description and drawings of the combination structure for combining the left side cover 402 will be omitted or briefly described.

As shown in FIGS. 1 and 3, the right side cover 403 is a substantially planar resin member that extends in the front-rear direction and the up-down direction on the right side of the laser printer 100. The right side cover covers the outsides of the upper second side plate 210R and the lower second side plate 250R. Ventilation slits, inner reinforcement ribs, and the like are formed at the right side cover 403, but are omitted or briefly shown in this embodiment.

As shown in FIG. 1, the front edge of the right side cover 403 coincides with the right edge of the closed front cover 401. A protrusion 403E, which protrudes toward the middle in the left-right direction while being covered with the closed front cover 401, is formed at an upper portion of the front edge of the right side cover 403. Meanwhile, the rear edge of the right side cover 403 coincides with the right edge of the rear cover 404. Protrusions 403F and 403G, which protrude toward the middle in the left-right direction and are covered with the rear cover 404, are formed at the rear edge of the right side cover 403. A through hole 92 is formed at each of the protrusions 403E, 403F, and 403G in the front-rear direction.

As shown in FIG. 2, a screw hole 91 is formed at an upper portion of the bent front edge of the upper second side plate 210R. Meanwhile, two screw holes 91 are formed at upper and lower portions of the bent rear edge of the upper second side plate 210R. When the right side cover 403 is mounted on the upper second side plate 210R as shown in FIG. 1, the through hole 92 of the protrusion 403E comes into contact with the screw hole 91, which is formed at the front end portion of the upper second side plate 210R, from the front side. Meanwhile, the respective through holes 92 of the protrusions 403F and 403G come into contact with the two screw holes 91, which are formed at the rear end portion of the upper second side plate 210R, from the rear side. Further, three locking screws 93 (which are shown in FIG. 2) are screwed into the screw holes 91 while being inserted into the through holes 92, respectively. Accordingly, the right side cover 403 is combined with the upper second side plate 210R at three (front and rear) positions without being restricted by the lower frame 250. According to this structure, a relative positional relationship between the upper second side plate 210R and the right side cover 403 is not changed even though the lower frame 250 is deformed. For this reason, the right side cover 403 is not easily deformed. As a result, it may be possible to prevent the deterioration of the appearance quality of the laser printer 100. Here, the screw holes 91, the through holes 92, and the locking screws 93 are one example of the "combining unit" of the invention.

Figure 6:
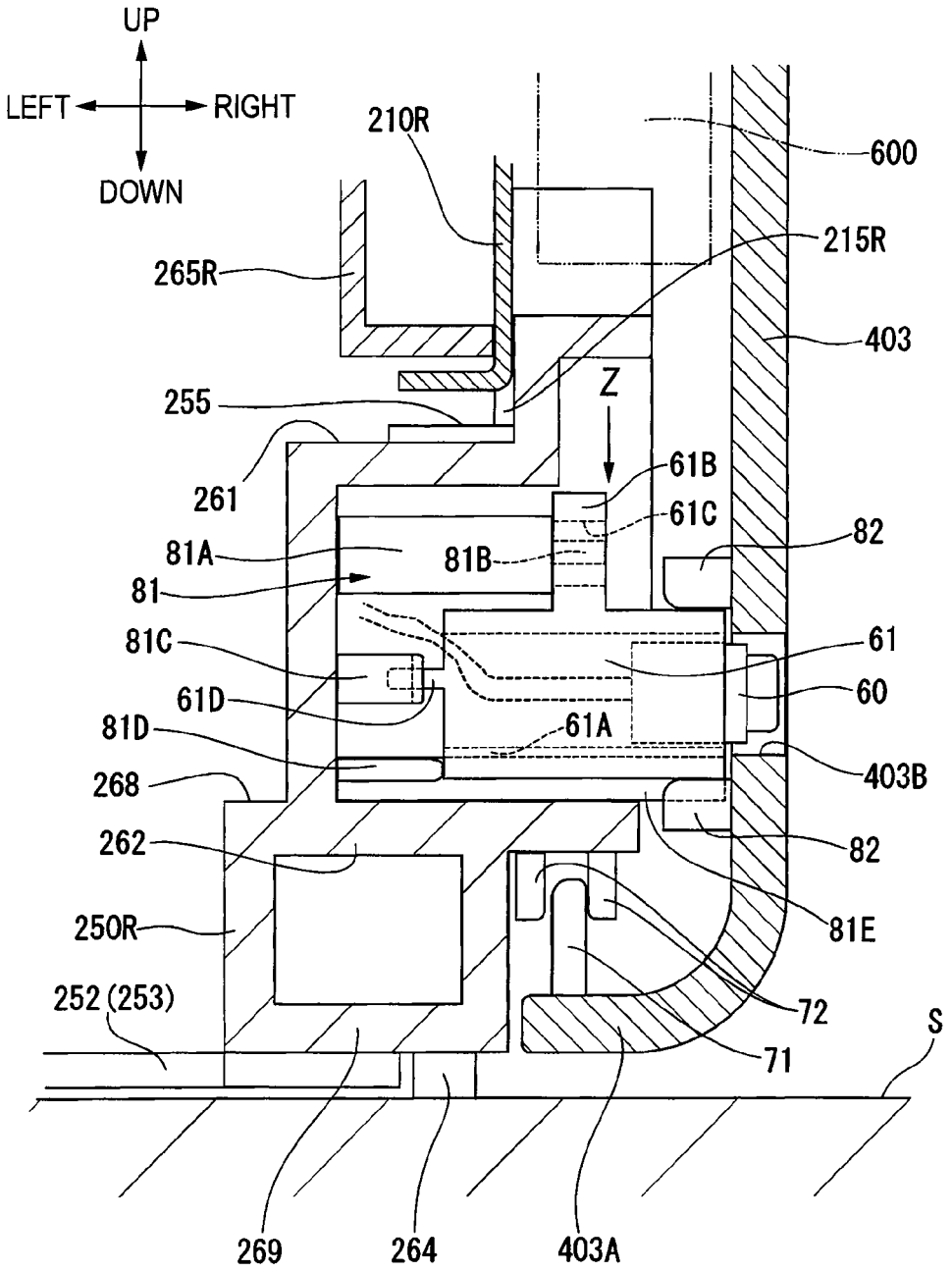
FIG. 6 is an enlarged cross-sectional view of the main parts, which are shown in FIG. 3, of the image forming apparatus according to the embodiment.

As enlarged and shown in FIG. 6, the lower edge 403A of the right side cover 403 is curved closer to the lower second side plate 250R (the feed tray 390) than the outer surface of the right side cover 403 that faces the outside in the left-right direction. In more detail, when seen in the front-rear direction, the lower edge 403A is bent in the shape of an arc having an angle of about 90° toward the outside of the lower wall 269 of the lower second side plate 250R in the left-right direction, and deeply penetrates the space that is secured below the intermediate wall 262 and opened to the outside in the left-right direction.

The radius of the arc of the lower edge 403A is large, that is, in the range of, for example, about 20 to 40 mm. If the lower edge of the right side cover 403 faces the placement surface S in a linear arrangement without being curved, a user can easily visually recognize a distance between the placement surface S and the lower edge of the right side cover. For this reason, if the lower frame 250 is deformed and the right side cover 403 and the upper frame 210 supported by the lower frame 250 are moved in the up-down direction, the change of the distance between the lower edge and the placement surface S is apt to be highly noticeable. In this regard, since the lower edge 403A is curved toward the lower second side plate 250R in this embodiment, the change of the distance between the lower edge 403A and the placement surface S is less noticeable even though the right side cover 403 is moved in the up-down direction due to the deformation of the lower frame 250. Meanwhile, without being limited to curving, the lower edge 403A may be bent closer to the lower second side plate 250R than the outer surface of the right side cover 403. In addition, the right side cover 403 may be formed in a rounded shape in the front-rear direction.

As shown in FIGS. 1 and 6, a plurality of guided portions 71, which are columnar ribs, protrudes from the leading end portion of the lower edge 403A toward the upper side, that is, toward the back of the intermediate wall 262 so as to be arranged in a line. Meanwhile, as shown in FIG. 6, guiding portions 72, which are a pair of columnar ribs protruding downward while nipping the guided portion 71 from both sides in the left-right direction, protrude from the back of the intermediate wall 262 at a plurality of positions corresponding to the respective guided portions 71.

A gap, which allows each of the guided portions 71 to be moved in the up-down direction by about several millimeters, is secured between each of the guided portions 71 and the back of the intermediate wall 262. Further, a small gap is secured between each guided portion 71 and each guiding portion 72 in the left-right direction, so that the relative movement in the left-right direction is regulated. Due to the guided portions 71 and the guiding portions 72, the movement of the right side cover 403 relative to the lower frame 250 in the up-down direction is allowed and the movement of the right side cover relative to the lower frame in the left-right direction is regulated. Accordingly, even though the upper frame 210 supported by the lower frame 250 is moved in the up-down direction due to the deformation of the lower frame 250, the right side cover 403 may be moved relative to the lower frame 250 in the up-down direction and may follow the movement of the upper frame 210. Further, the right side cover 403 does not approach the lower frame or become separated from the lower frame 250 in the left-right direction. Therefore, it may be possible to reliably prevent the deterioration of the appearance quality of the laser printer 100.

Here, the guided portions 71 and the guiding portions 72 are one example of a "regulation mechanism" of the invention. Meanwhile, the shapes of the guided portion 71 and the guiding portion 72 are not limited to the above-mentioned shapes. For example, the guiding portion 72 may be a hole into which the guided portion 71 is inserted.

As shown in FIG. 1, a power connector inlet 403C, which is opened and has a rectangular shape, is formed at a lower portion of the rear end portion of the right side cover 403, and a power connector connecting terminal 69 is provided in the power connector inlet 403C. After being fitted to a cutout portion 250A that is formed at the rear surface of the lower second side plate 250R as shown in FIG. 2, the power connector connecting terminal 69 is screwed and fixed to the lower second side plate 250R. Accordingly, the power connector connecting terminal is positioned relative to the power connector inlet 403C.

Further, a rectangular opening 403B is formed at a lower portion of the rear portion of the right side cover 403, and a power switch 60 (which is one example of a "mounting member") is provided so that a movable portion of the power switch is exposed to the outside. As described below, the power switch 60 is mounted on the lower second side plate 250R so that any deviation of the position of the power switch relative to the opening 403B is suppressed.

As shown in FIG. 6, the power switch 60 is a well-known general-purpose component to which two cables are connected. In this embodiment, the power switch 60, which is a general-purpose component, is inserted into a holder 61 made of a resin and the power switch 60 is mounted on the lower second side plate 250R through the holder 61. Assembling the power switch 60 is simplified as a result of this structure.

Figure 7A:
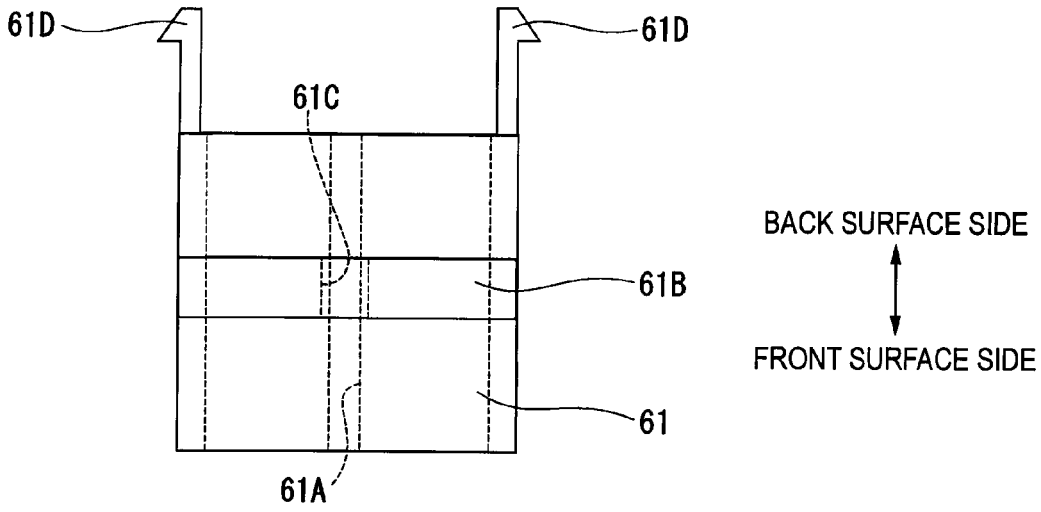
FIG. 7A is a top view of a holder of the image forming apparatus according to the embodiment.
Figure 7B:
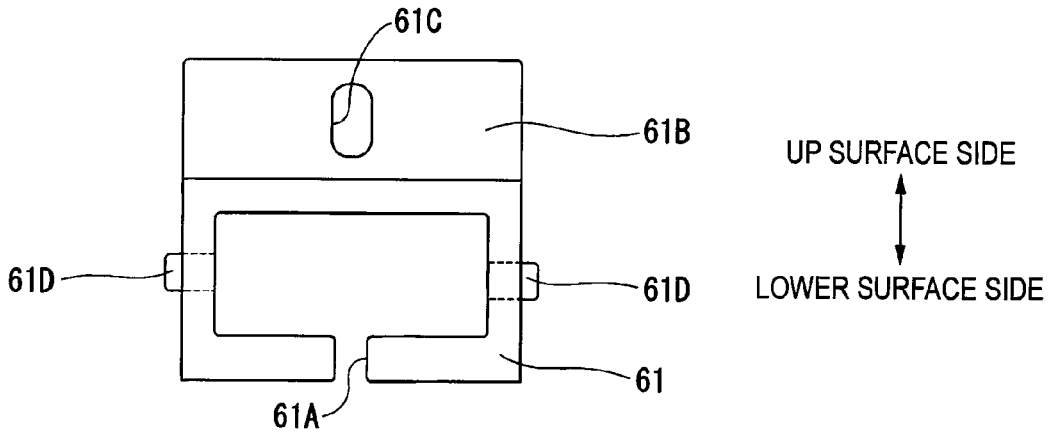
FIG. 7B is a front view of the holder.

As shown in FIGS. 7A and 7B, the holder 61 is a substantially cylindrical body having a rectangular cross-section. Meanwhile, the front surface, the back surface, the upper surface, and the lower surface are shown in FIG. 7. A slit 61A extending in a longitudinal direction (a direction directed to a back surface side from a front surface side) is formed at the lower wall of the holder 61. When the power switch 60 is inserted into the holder 61, it may be possible to lead the cables of the power switch 60 into the holder 61 through the slit 61A. Accordingly, it may be possible to previously connect the power connector connecting terminal 69 and the cables of the power switch 60, so that the manufacturing process is simplified.

A screen portion 61B, which stands up in the shape of a screen, is formed near the middle of the upper wall of the holder 61 in the longitudinal direction, and a long hole 61C, which is long in the up-down direction, is formed at the center of the screen portion. Further, a pair of engaging claw portions 61D further protrudes from the end faces, which are close to the back surface side, of both side walls of the holder 61 toward the back surface side.

Meanwhile, as shown in FIG. 2, a holding mechanism 81 for holding the power switch 60 through the holder 61 is provided at a rear portion of the surface of the lower second side plate 250R that faces the outside in the left-right direction. As shown in more detail in FIGS. 6, 8, and 9, the holding mechanism 81 includes an upper prism portion 81A, a columnar protruding portion 81B that protrudes from the end of the prism portion 81A, a pair of engaged portions 81C that is positioned below the prism portion 81A and has a distance therebetween in the front-rear direction, a pair of prism portions 81D that is positioned below the respective engaged portions 81C and has a distance therebetween in the front-rear direction, and a foreign material entry preventing rib 81E that is positioned below each of the prism portions 81D and just below the prism portion 81A. Each of the prism portion 81A, the columnar protruding portion 81B, the respective engaged portions 81C, and the respective prism portions 81D, and the foreign material entry preventing rib 81E protrudes toward the outside in the left-right direction.

When the holder 61 is mounted on the holding mechanism 81, the prism portion 81A comes into contact with the screen portion 61B and the columnar protruding portion 81B is inserted into the long hole 61C. Further, the respective engaged portions 81C are engaged with the respective engaging claw portions 61D, and the respective prism portions 81D come into contact with the rear end face, which is close to the lower wall, of the holder 61. Accordingly, the holder 61 is positioned relative to the lower second side plate 250R in the front-rear direction and the left-right direction. Meanwhile, the contact positions and the engagement positions between the holder 61 and the prism portion 81A, the columnar protruding portion 81B, the respective engaged portions 81C, and the respective prism portions 81D slide in the up-down direction. Accordingly, as shown in FIG. 10, the movement of the holder 61 relative to the lower second side plate 250R in the up-down direction is allowed. FIG. 10 shows that the holder 61 is moved upward in the state of FIG. 9. Although not shown, a case where the holder 61 is moved downward in the state of FIG. 9 is also the same as described above.

Figure 8:
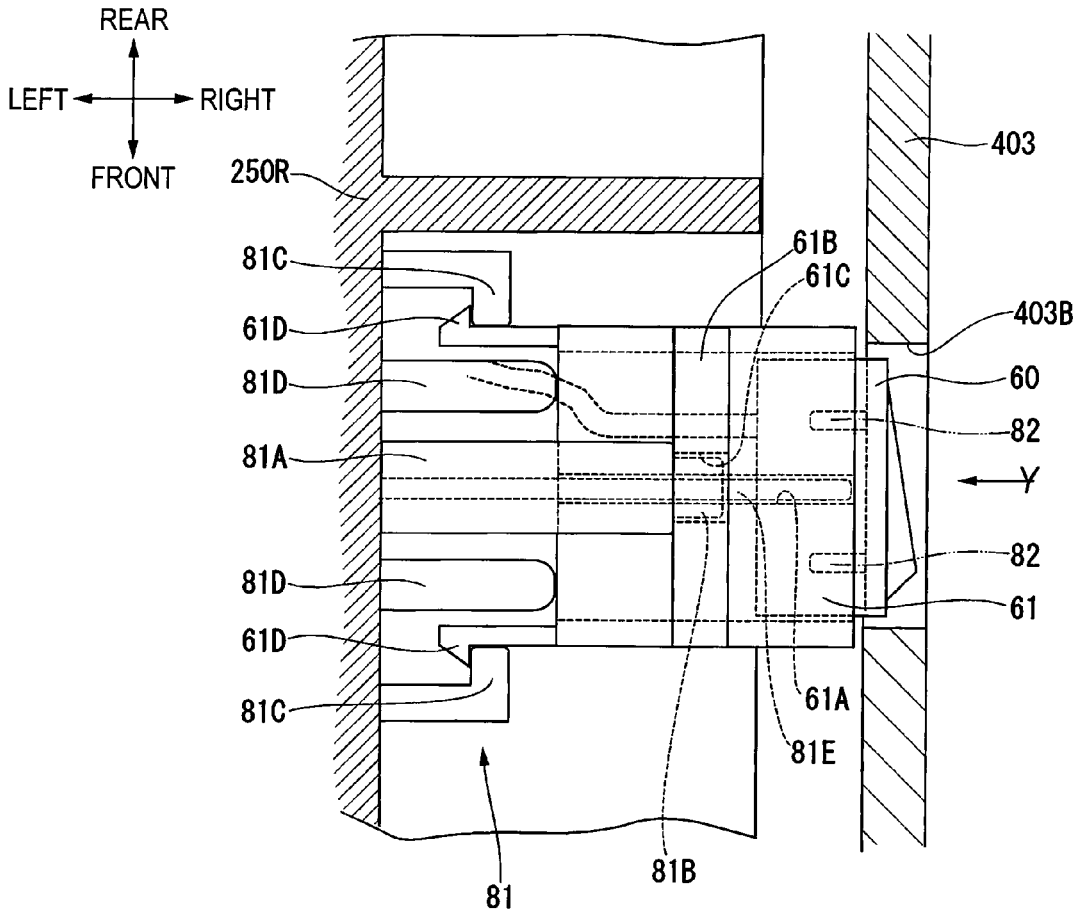
FIG. 8 is an enlarged top view (partial cross-sectional view) of the main parts of the image forming apparatus according to the embodiment when seen in the direction of an arrow Z of FIG. 6.
Figure 9:
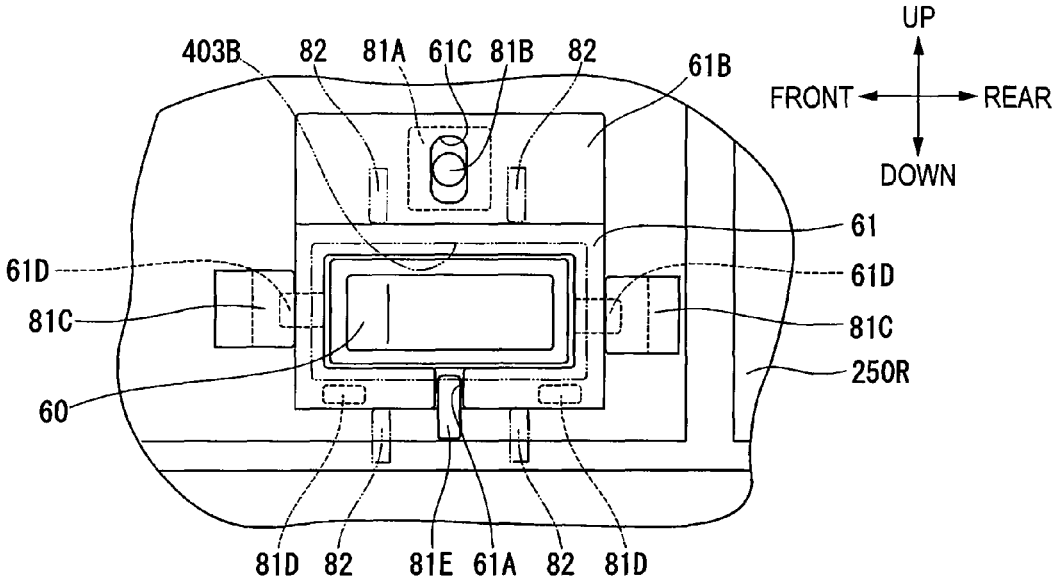
FIG. 9 is an enlarged side view of the main parts of the image forming apparatus according to the embodiment when seen in the direction of an arrow Y of FIG. 8 (an opening and grippers of a right side cover are shown by a two-dot chain line)
Figure 10:
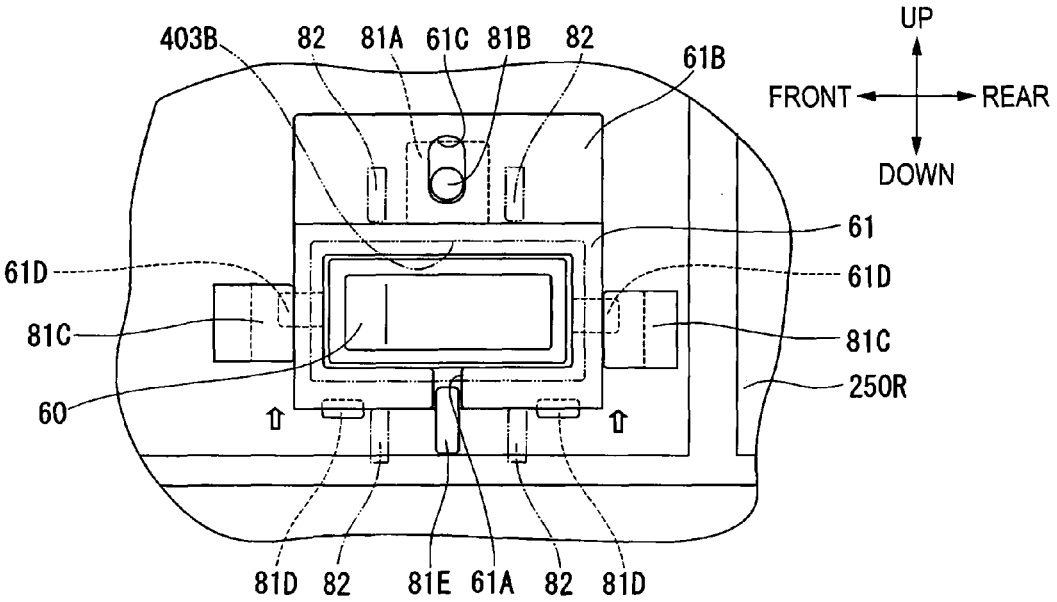
FIG. 10 is an enlarged side view of the main parts of the image forming apparatus according to the embodiment when seen in the direction of an arrow Y of FIG. 8 (the opening and the grippers of a right side cover are shown by a two-dot chain line).

Meanwhile, as shown in FIGS. 6, 8, and 9, grippers 82, which protrude toward the lower second side plate 250R, are formed on the surface of the right side cover 403 that faces the inside in the left-right direction. The plurality of grippers 82 is provided above and below the opening 403B. A distance between the upper gripper 82 and the lower gripper 82 is slightly larger than a distance between the upper and lower surfaces of the holder 61. Further, if the right side cover 403 is assembled with the upper second side plate 210R while the holder 61 is mounted on the holding mechanism 81, the respective grippers 82 grip the holder 61 in the up-down direction. Accordingly, the holder 61 is positioned relative to the opening 403B in the up-down direction. The holding mechanism 81 and the grippers 82 are one example of an "interlocking mechanism" of the invention.

If the right side cover 403 is moved relative to the lower second side plate 250R in the up-down direction due to the deformation of the lower frame 250, as shown in FIGS. 9 and 10, the power switch 60 and the holder 61 are gripped on the right side cover 403 by the grippers 82 and are moved in the up-down direction together with the right side cover 403 (the grippers 82 positioned on the front side of the planes of FIGS. 9 and 10 are shown by a two-dot chain line). In this case, the holding mechanism 81 holds the power switch 60 and the holder 61 on the lower second side plate 250R while allowing the relative movement of the power switch 60 and the holder 61 relative to the lower second side plate 250R in the up-down direction. Accordingly, since the deviation of the position of the power switch 60 relative to the opening 403B (the opening 403B positioned on the front side of the planes of FIGS. 9 and 10 is shown by a two-dot chain line) is reliably suppressed, it may be possible to prevent a gap from being formed between the periphery of the opening 403B and the power switch 60, and to reliably prevent the deterioration of the appearance quality of the laser printer 100.

Meanwhile, as shown in FIGS. 6 and 8 to 10, even though the holder 61 is moved together with the right side cover 403 in the up-down direction when being held at the holding mechanism 81 and gripped by the grippers 82, the foreign material entry preventing rib 81E is always positioned in the slit 61A. Therefore, it may be possible to reliably prevent thin foreign materials such as wires from entering from the opening 403B along the slit 61A. Meanwhile, the foreign material entry preventing rib 81E may be employed for a mounting member (for example, USB port or the like) other than the power switch 60 and a member including a slit capable of communicating with the opening 403B. Accordingly, the foreign material entry preventing rib can prevent foreign materials from entering through the slit.

<Advantages>

In the laser printer 100 according to the embodiment, combining unit (that is, the respective screw holes 91 that are formed at the upper second side plate 210R, the respective through holes 92 that are formed at the right side cover 403, and the respective locking screws 93 that are screwed into the respective screw holes 91 while being inserted into the respective through holes 92), which combines the right side cover 403 with the upper frame 210 without being restricted by the lower frame 250, is provided between the upper frame 210 and the right side cover 403 (or the left side cover 402).

For this reason, even when an impact is applied to the upper frame 210 from above or the lower frame 250 is deformed by being placed on the placement surface S having irregularities, the deformation of the lower frame 250 does not easily affect the right side cover 403. That is, even though the lower second side plate 250R of the lower frame 250 is deformed, only the relative positional relationship between the lower frame 250, and the upper frame 210 and the right side cover 403 is changed, so that the relative positional relationship between the upper frame 210 and the right side cover 403 is not changed. For this reason, the right side cover 403, which is not restricted by the lower second side plate 250R and is combined with the upper second side plate 210R, is not easily deformed. Although not described, the left side cover 402 is likewise not easily deformed.

Accordingly, according to the laser printer 100 of the embodiment, it may be possible to prevent the deterioration of the appearance quality of the entire laser printer 100 that is caused by the deformation of the lower frame 250.

Further, in the laser printer 100, each of the lower first side plate 250L and the lower second side plate 250R is a resin member, and each of the upper first side plate 210L and the upper second side plate 210R is a metal member. For this reason, if a large load is continuously applied for a long time to the lower first side plate 250L and the lower second side plate 250R formed of resin members, there is a concern that creep deformation will occur on the lower first side plate 250L and the lower second side plate 250R. In this case, for example, the height of the upper frame 210, which is supported by the lower frame 250, from the placement surface S may be steadily decreased by about 1 to 2 mm. However, since the creep deformation of the lower first side plate 250L and the lower second side plate 250R does not easily affect the left side cover 402 and the right side cover 403 as described above, it may be possible to reliably prevent the deterioration of the appearance quality of the laser printer.

Further, the laser printer 100 includes a power switch 60 as one example of a mounting member. Further, the power switch 60 is provided at a lower portion of the right side cover 403, which is close to the power connector connecting terminal 69, that is, at a position that is positioned near the lower frame 250 to be easily deformed and is easily visible to a user, so that the length of a cable for connecting the power switch 60 to the power connector connecting terminal 69, which is provided at a low position for the handling of a power cord, is reduced as much as possible and a user easily operates the laser printer. Here, if the position of the power switch 60, which is partially exposed through the opening 403 formed at the right side cover 403, is deviated from the opening 403, appearance quality deteriorates. However, in this embodiment, it may be possible to suppress the deviation of the position of the power switch by using the holding mechanism 81 and the grippers 82 as an interlocking mechanism. Therefore, it may be possible to reliably prevent the deterioration of the appearance quality of the laser printer.

The embodiment of the invention has been described above. However, the invention is not limited to the above-mentioned embodiment, and it goes without saying that the invention may be appropriately modified without departing from the scope of the invention.

For example, an operating switch for switching an input, settings, and the like; a display, such as a LED or liquid crystal; an outlet; a USB port; various connector connecting ports; and other various interfaces (which are interposed between the outside of an image forming apparatus and the inside of the apparatus and perform various kind of transmission) may be employed as the mounting member.

Further, the structures of the upper frame 210 and the lower frame 250 are also not limited to the above-mentioned embodiment. For example, the upper first side plate 210L and the upper second side plate 250L may be formed of an integrated component that is connected in a U-shape on the upper surface side or the back surface side. Furthermore, the lower first side plate 250L and the lower second side plate 250R may be formed of an integrated component that is connected in a U-shape on the lower surface side or the back surface side.

In addition, the same combination structure as the combination structure for combining the left side cover 402 and the right side cover 403 with the main body frame 200 may be employed to a front cover and a rear cover (when a fixing cover is a prerequisite).

The invention may be used in an image forming apparatus.

According to the first aspect of the exemplary embodiment, there is provided an image forming apparatus comprising: a main body frame that is placed on a placement surface; an image forming unit that is provided at an upper portion in the main body frame and forms an image on a recording medium; and a accommodation unit that is provided at a lower portion in the main body frame and accommodates the recording medium to be fed to the image forming unit, wherein the main body frame includes an upper frame that supports the image forming unit, and a lower frame that has a rigidity lower than the rigidity of the upper frame, supports the upper frame from below, and supports the accommodation unit, the upper and lower frames are covered with a cover member, and a combining unit is provided between the upper frame and the cover member, and combines the cover member with the upper frame without being restricted by the lower frame.

According to the first aspect, the rigidity of the lower frame is set to be lower than that of the upper frame. Accordingly, manufacturing costs are reduced. Further, even when the lower frame is deformed by being placed on a placement surface having irregularities, the upper frame supporting the image forming unit is not easily deformed, so that high positional accuracy of the image forming unit is maintained and the deterioration of image quality at the time of image formation is prevented.

Furthermore, in the image forming apparatus of the first aspect, the cover member is combined with the upper frame by a combining unit without being restricted by the lower frame. Therefore, even when the lower frame is deformed, the deformation of the lower frame does not easily affect the cover member. That is, even though the lower frame is deformed, only the relative positional relationship between the lower frame, and the upper frame and the cover member is changed, so that the relative positional relationship between the upper frame and the cover member is not changed. For this reason, the cover member, which is not restricted by the lower frame and is combined with the upper frame, is not easily deformed.

Accordingly, the image forming apparatus according to the first aspect can reliably prevent the deterioration of appearance quality.

According to the second aspect, in addition to the first aspect, a regulation mechanism that is provided between the lower frame and the cover member, and regulates a relative movement of the cover member relative to the lower frame in other directions while allowing a relative movement of the lower frame relative to the cover member in an up-down direction.

According to this structure, even though the upper frame supported by the lower frame is moved in the up-down direction due to the deformation of the lower frame, the cover member may be moved relative to the lower frame in the up-down direction by the regulation mechanism and may follow the movement of the upper frame. Further, the cover member does not approach the lower frame nor become separated from the lower frame in other directions by the regulation mechanism. Therefore, it may be possible to reliably prevent the deterioration of appearance quality.

According to the third aspect, in addition to the second aspect, the regulation mechanism includes a guided portion that is formed at one of the lower frame and the cover member and extends in the up-down direction, and a guiding portion that is formed at the other thereof and guides the guided portion.

It may be possible to prevent the deterioration of appearance quality by the regulation mechanism that is a specific structure.

According to the fourth aspect, in addition to anyone of the first aspect to the third aspect, the cover member includes an opening that is opened to the lower frame, a mounting member is mounted on the lower frame so that at least a part of the mounting member is exposed to the outside through the opening, and an interlocking mechanism that is provided between the lower frame and the cover member, and moves the mounting member in the up-down direction so as to interlock with the upward and downward movement of the opening.

According to this structure, even though the upper frame and the cover member are moved in the up-down direction due to the deformation of the lower frame, the mounting member is moved in the up-down direction by the interlocking mechanism and may interlock with the upward and downward movement of the opening. Therefore, the deviation of the position of the mounting member relative to the opening is suppressed, so that it may be possible to prevent the deterioration of appearance quality.

According to the fifth aspect, in addition to the fourth aspect, the interlocking mechanism includes a holding mechanism that holds the mounting member on the lower frame while allowing a movement of the mounting member relative to the lower frame in the up-down direction, and a gripper that is formed at the cover member, protrudes toward the lower frame, and grips the mounting member.

According to this structure, the relative movement of the mounting member relative to the lower frame in the up-down direction is allowed by the holding mechanism. Further, if the cover member is moved relative to the lower frame in the up-down direction, the mounting member is gripped on the cover member by the grippers and is moved in the up-down direction together with the cover member. For this reason, the deviation of the position of the mounting member relative to the opening is reliably suppressed, so that it may be possible to reliably prevent the deterioration of appearance quality.

According to the sixth aspect, in addition to the fourth aspect or the fifth aspect, the mounting member is a power switch.

In order to reduce the length of a cable for connecting the power switch to the power connector connecting terminal as much as possible, the power switch is generally provided at a position close to the power connector inlet. Further, the power connector is generally provided at a low position in order to easily handle the power cord. Accordingly, the power switch is generally provided at a low position. Specifically, this position corresponds to a lower portion of the side surface of the image forming apparatus, that is, a position that is positioned near the easily deformed lower frame and is easily visible to a user. Moreover, in this case, if the power switch is partially exposed through the opening by the structure of claim 4, the deviation of the position of the power switch relative to the opening is suppressed. Accordingly, it may be possible to reliably prevent the deterioration of the appearance quality of the image forming apparatus.

According to the seventh aspect, in addition to anyone of the first aspect to the sixth aspect, a lower edge of the cover member is curved or bent toward the received accommodation unit from an outer surface of the cover member.

According to this structure, even though the distance between the placement surface and the lower edge of the cover member is changed due to the deformation of the lower frame, it may be possible to make the change of distance less noticeable.

According to the eighth aspect, in addition to the first aspect to the seventh aspect, the lower frame includes a lower first side plate that extends in the up-down direction, a lower second side plate that extends in the up-down direction with a distance between the lower first side plate and the lower second side plate and faces the lower first side plate, and a lower connecting member that connects the lower first side plate to the lower second side plate, the upper frame includes an upper first side plate that extends in the up-down direction, an upper second side plate that extends in the up-down direction with a distance between the upper first side plate and the upper second side plate and faces the upper first side plate, and an upper connecting member that connects the upper first side plate to the upper second side plate, the accommodation unit is supported by the lower first side plate and the lower second side plate, the image forming unit is supported by the upper first side plate and the upper second side plate, and the cover member covers at least the lower first side plate, the lower second side plate, the upper first side plate, and the upper second side plate.

According to this specific structure, the rigidity of the lower first side plate and the lower second side plate is set to be lower than that of the upper first side plate and the upper second side plate. Accordingly, it may be possible to easily make the rigidity of the lower frame be lower than the rigidity of the upper frame. As a result, it may be possible to reduce manufacturing costs and to reliably prevent the deterioration of image quality at the time of image formation.

According to the ninth aspect, in addition to the eighth aspect, the lower first side plate and the lower second side plate are resin members, and the upper first side plate and the upper second side plate are metal members.

According to this structure, it may be possible to easily make the rigidity of the lower first side plate and the lower second side plate, which are resin members, be lower than the rigidity of the upper first side plate and the upper second side plate, which are metal members. Further, in the case of this structure, if a large load is continuously applied for a long time to the lower first side plate and the lower second side plate formed of resin members, there is a concern that creep deformation occurs on the lower first side plate and the lower second side plate. However, since the creep deformation of the lower first side plate and the lower second side plate of the lower frame does not easily affect the cover member as described above, it may be possible to reliably prevent the deterioration of appearance quality.

According to the tenth aspect, in addition to anyone of the first aspect to the ninth aspect, the combining unit includes a screw hole that is formed at one of the upper frame and the cover member, a through hole that is formed at the other of the upper frame and the cover member, and a locking screw that is screwed into the screw hole while being inserted into the through hole.

It may be possible to reliably combine the cover member with the upper frame by the combining unit that is a specific structure.

What is claimed is:

1. An image forming apparatus comprising:

a main body frame that is placed on a placement surface;

an image forming unit that is provided at an upper portion in the main body frame and is configured to form an image on a recording medium; and an accommodation unit that is provided at a lower portion in the main body frame and is configured to accommodates the recording medium to be fed to the image forming unit, wherein the main body frame includes an upper frame that supports the image forming unit, and a lower frame that has a rigidity lower than the rigidity of the upper frame supports the upper frame from below, and supports the accommodation unit, and the upper and lower frames are covered with a cover member, and wherein the image forming apparatus further comprises a combining unit provided between the upper frame and the cover member, and configured to combine the cover member with the upper frame without being restricted by the lower frame; and a regulation mechanism that is provided between the lower frame and the cover member, and is configured to regulate relative movement of the cover member relative to the lower frame in other directions while allowing relative movement of the lower frame relative to the cover member in an up-down direction.

2. The image forming apparatus according to claim 1, wherein the regulation mechanism includes a guided portion that is formed at one of the lower frame and the cover member and extends in the up-down direction, and a guiding portion that is formed at the other of the lower frame and the cover member and guides the guided portion.

3. The image forming apparatus according to claim 1, wherein the cover member includes an opening that is opened to the lower frame, and the image forming apparatus further comprises a mounting member is mounted on the lower frame so that at least a part of the mounting member is exposed to the outside through the opening, and an interlocking mechanism provided between the lower frame and the cover member, and configured to move the mounting member in the up-down direction so as to interlock with upward and downward movement of the opening.

4. The image forming apparatus according to claim 3, wherein the interlocking mechanism includes a holding mechanism that holds the mounting member on the lower frame while allowing movement of the mounting member relative to the lower in the up-down direction, and a gripper that is formed at the cover member, protrude toward the lower frame, and grips the mounting member.

5. The image forming apparatus according to claim 3, wherein the mounting member is a power switch.

6. The image forming apparatus according to claim 1, wherein a lower edge of the cover member is curved or bent toward the accommodation unit from an outer surface of the cover member.

7. The image forming apparatus according to claim 1, wherein the lower frame includes a lower first side plate that extends in the up-down direction, a lower second side plate that extends in the up-down direction with a distance between the lower first side plate and the lower second side plate and faces the lower first side plate, and a lower connecting member that connects the lower first side plate to the lower second side plate, the upper frame includes an upper first side plate that extends in the up-down direction, an upper second side plate that extends in the up-down direction with a distance between the upper first side plate and the upper second side plate and faces the upper first side plate, and an upper connecting member that connects the upper first side plate to the upper second side plate, the accommodation unit is supported by the lower first side plate and the lower second side plate, the image forming unit is supported by the upper first side plate and the upper second side plate, and the cover member covers at least the lower first side plate, the lower second side plate, the upper first side plate, and the upper second side plate.

8. The image forming apparatus according to claim 7, wherein the lower first side plate and the lower second side plate are resin members, and the upper first side plate and the upper second side plate are metal members.

9. The image forming apparatus according to claim 1, wherein the combining unit includes a screw hole that is formed at one of the upper frame and the cover member, a through hole that is formed at the other of the upper frame and the cover member, and a locking screw that is screwed into the screw hole while being inserted into the through hole.

10. An image forming apparatus comprising:

a main body frame configured to be placed on a placement surface;

an image forming unit that is provide at an upper portion in the main body frame and is configured to form an image on a recording medium; and an accommodation unit that is provided at a lower portion in the main body frame and is configured to accommodate the recording medium to be fed to the image forming unit, wherein the main body frame includes an upper frame that supports the image unit, and a lower frame that has a rigidity lower than a rigidity of the upper frame, supports the upper frame from below, and supports the accommodation unit, and the upper and lower frames are covered by an external housing, and wherein the image forming apparatus further comprises an attachment coupling for attaching the upper frame and the external, housing wherein the external housing is attached with the upper frame without being fixed to the lower frame; and a regulation mechanism that is provided between the lower frame and the external housing, and is configured to regulate relative movement of the external housing relative to the lower frame in other directions while allowing relative movement of the lower frame relative to the external housing in an up-down direction.

11. The image forming apparatus according to claim 10, wherein the regulation mechanism includes a guided portion that is formed at one of the lower frame and the external housing and extends in the up-down direction, and guiding portion that is formed at the other of the lower frame and the external housing and guides the guided portion.

12. An image forming apparatus comprising:

a main body frame configured to be placed on a placement surface;

an image forming unit that is provided at an upper portion in the main body frame and is configured to form an image on a recording medium; and an accommodation unit that is provided at a lower portion in the main body frame and is configured to accommodate the recording medium to be fed to the forming unit, wherein the main body frame includes an upper frame that supports the image forming unit, and a lower frame that has a rigidity lower than a rigidity of the upper frame, supports the upper frame from below, and supports the accommodation unit, the upper and lower frames are covered by an external housing, and an attachment coupling for attaching the upper frame and the external housing, wherein the external housing is attached with the upper frame without being fixed to the lower frame, and wherein the external housing includes an opening that is opened toward the lower frame, and the image forming apparatus further comprises a mounting member mounted on the lower frame so that at least a part of the mounting member is exposed to the outside through the opening, and an interlocking mechanism provided between the lower frame and the external housing, and configured to move the mounting member in an up-down direction so as to interlock with upward and downward movement of the opening.

13. The image forming apparatus according to claim 12, wherein the interlocking mechanism includes a holding mechanism that holds the mounting member on the lower frame while allowing movement of the mounting member relative to the lower frame in the up-down direction, and a gripper that is formed at the external housing, protrudes toward the lower frame, and grips the mounting member.

14. The image apparatus according to claim 12, wherein the mounting member is a power switch.

15. The image forming apparatus to claim 10, wherein a lower edge of the external housing is curved or bent toward the accommodation unit from an other surface of the external housing.

16. The image forming apparatus according to claim 10, wherein the lower frame includes a lower first side plate that extends in an up-down direction, a lower second side plate that extends in the up-down direction with a distance between the lower first side plate and the lower second side plate and faces the lower first side plate, and a lower connecting member that connects the lower first side plate to the lower second side plate, the upper frame includes an upper first side plate that extends in the up-down direction, an upper second side plate that extends in the up-down direction with a distance between the upper first side plate and the upper second side plate and faces the upper first side plate, and an upper connecting member that connects the upper first side plate to the upper second side plate, the accommodation unit is supported by the lower first side plate and the lower second side plate, the image forming unit is supported by the upper first side plate and the upper second side plate, and the external housing covers at least the lower first side plate, the lower second side plate, the upper first side plate, and the upper second side plate.

17. The image forming apparatus according to claim 16, wherein the lower first side plate and the lower second side plate are resin members, and the upper first side plate and the upper second side plate are metal members.

18. The image forming apparatus according to claim 10, wherein the attachment coupling includes a screw hole that is formed at one of the upper frame and the external housing, a through hole that is formed at the other of the upper frame and external housing, and a locking screw that is screwed into the screw hole while being inserted into the through hole.

* * * * *

UNITED STATES PATENT AND TRADEMARK OFFICE

CERTIFICATE OF CORRECTION

PATENT NO. : 8,731,433 B2
APPLICATION NO. : 12/886084
DATED : May 20, 2014
INVENTOR(S) : Hakudai Kondo It is certified that error appears in the above-identified patent and that said Letters Patent is hereby corrected as shown below:

In the claims

Column 19, Claim 1, Line 31:
Please delete "that is" and insert --configured to be--

Column 19, Claim 1, Lines 36-37:
Please delete "accommodates" and insert --accommodate--

Column 19, Claim 1, Line 42:
Please delete "the" and insert --a--

Column 19, Claim 1, Line 42:
After "frame" insert --,--

Column 20, Claim 3, Line 1:
After "member" delete "is"

Column 20, Claim 3, Line 6:
Please delete "the" and insert --an--

Column 20, Claim 4, Line 13:
After "lower" insert --frame--

Column 20, Claim 4, Line 15:
Please delete "protrude" and insert --protrudes--

Column 20, Claim 7, Line 27:
Please delete "the" and insert --an--

Signed and Sealed this
First Day of December, 2015

Michelle K. Lee

Michelle K. Lee
*Director of the United States Patent and Trademark Office*

Column 20, Claim 10, Line 61:
Please delete “provide” and insert --provided--

Column 21, Claim 10, Line 3:
After “image” insert --forming--

Column 21, Claim 10, Line 11:
Please delete “external, housing” and insert --external housing--

Column 21, Claim 11, Line 23:
After “and” insert --a--

Column 21, Claim 12, Line 34:
After “the” insert --image--

Column 22, Claim 14, Line 12:
After “image” insert --forming--

Column 22, Claim 15, Line 14:
After “apparatus” insert --according--

Column 22, Claim 15, Line 16:
Please delete “other” and insert --outer--

Column 22, Claim 18, Line 51:
After “and” insert --the--